US005179395A

United States Patent [19]

Kato

[11] Patent Number: 5,179,395

[45] Date of Patent: Jan. 12, 1993

[54] MULTI-MODE IMAGE FORMING APPARATUS

[75] Inventor: Akio Kato, Toyokawa, Japan

[73] Assignee: Minolta Camera Kabushiki Kaisha, Osaka, Japan

[21] Appl. No.: 885,676

[22] Filed: May 19, 1992

[30] Foreign Application Priority Data

Jun. 7, 1991 [JP] Japan ..... 3-163548

[51] Int. Cl.[5] ..... G03G 15/08

[52] U.S. Cl. ..... 346/157; 355/328; 355/327; 355/245

[58] Field of Search ..... 346/157, 160, 153.1; 355/327, 328, 313, 245

[56] References Cited

U.S. PATENT DOCUMENTS 4,275,958 6/1981 Tachika et al. .
4,512,655 4/1985 Ishida et al. ..... 355/55
4,641,954 2/1987 Miyata et al. .
4,761,668 8/1988 Parker et al. .
4,862,216 8/1989 Higashi et al. ..... 355/218
4,959,695 9/1990 Mishimura et al. ..... 355/327
4,998,145 3/1991 Haneda et al. ..... 355/327
5,040,031 8/1991 Hayashi ..... 355/326 X
5,063,127 11/1991 Oka et al. ..... 430/45
5,097,296 3/1992 Goto et al. ..... 355/328
5,113,202 5/1992 Loce et al. ..... 346/108

*Primary Examiner*—Richard L. Moses
*Attorney, Agent, or Firm*—Burns, Doane, Swecker & Mathis

[57] ABSTRACT

Copying apparatus operable in two-color mode using two developing devices. The copy operation in the two-color mode forms an electrostatic latent image on a photosensitive member by means of exposure to image light, develops said latent image using two developing devices, and after developing performs an inter-image process to remove the different color developing material contaminating the developing devices. Mode changes are prohibited during image exposure, but are permitted during the inter-image process.

8 Claims, 6 Drawing Sheets

MULTI-MODE IMAGE FORMING APPARATUS

BACKGROUND OF THE INVENTION

1. Field of the Invention

The present invention relates to an image forming apparatus operable in a plurality of modes, and more specifically relates to an image forming apparatus having, for example, a plurality of developing devices installed therein so as to be capable of executing a single-color mode for forming images using a single developing device and a multi-color mode for forming images using a plurality of said developing devices.

2. Description of the Related Art

Image forming apparatus of the electrophotographic type such as copying apparatus, page printers and the like, are provided with a plurality of developing devices accommodating developing materials of different colors, which form single-color images or multi-color images (hereinafter referred to as two-color images) via operation modes corresponding to specified image colors. For example, an apparatus is disclosed in U.S. Pat. No. 4,862,216 having three functions for forming images in black, red, and both red and black.

After a plurality of developing units are operated in parallel to form two-color images, a particular developing unit may be easily contaminated by toner from another developing unit. When the developing unit containing the mixed toners of a plurality of colors is allowed to stand in said mixed state, the subsequent formation of single-color images may produce color muddiness of said images. Therefore, a so-called toner separation process must be performed to eliminate the aforesaid mixed toner.

In general, toner separation methods such as that disclosed in U.S. Pat. No. 5,063,127 set the relative electric potential difference (electrostatic contrast) between the developing units and the photosensitive member at different values during image formation. Thus, the adhesion of unnecessary toner in the developing unit to the surface of the latent image bearing member (photosensitive member) is eliminated by using different adhesion charge characteristics for toners of each color.

The toner separation process using the aforementioned method is accomplished as a so-called inter-image process within the electrophotographic process, wherein the process timing is set so as to use the region of the surface of the photosensitive member that is unaffected by the image.

In conventional copying apparatus, for example, operation setting for each portion are executed in accordance with the specified operation mode prior to the copying process, then the copy operation is started when the print key is depressed. During the copying operation, control is accomplished so as to discriminate the operation mode at the moment the toner separation process becomes executable, and when the result of said discrimination determines that the two-color image forming mode is specified, the toner separation process is executed as an inter-image process.

Conventionally, the operation mode is maintained for the toner separation process even after it is determined in the image forming process that distinguishing the operation mode for image color is unnecessary at the completion of exposure and developing.

That is, changing the operation mode is prohibited at least at the moment the toner separation process is started.

In actual practice, for, example, in the sorting mode for sorting the recording sheets (hereinafter referred to as "paper sheets") using a sorter, changing the operation mode is prohibited until a predetermined number of paper sheets have been completely discharged. In order to simplify control, the operation modes for image color are prohibited form being changed until the paper sheets are completely discharged, i.e., until the copying operation is completed.

Accordingly, when making consecutive copies in different operation modes such as, for example, copying in the single-color mode after the two-color mode, conventional methods are disadvantageous inasmuch as a long period elapses from the start of two-color mode copying until the point at which the color may be specified for the single-color copying.

Therefore, the number of copies per unit time is reduced, thereby slowing the copy speed and unavoidably lengthening the amount of time the operator must wait for the operation to be completed.

SUMMARY OF THE INVENTION

A main object of the present invention is to provide an image forming apparatus having excellent operating characteristics.

The aforesaid object of the invention is accomplished by providing an image forming apparatus capable of changing the operation mode set prior to image formation after completion of the image exposure on the photosensitive member.

The aforesaid object of the invention is further accomplished by providing an image forming apparatus capable of changing the operation mode set prior to image formation during an image forming process executed continuously after image formation.

DESCRIPTION OF THE PREFERRED EMBODIMENTS

Figure 1:
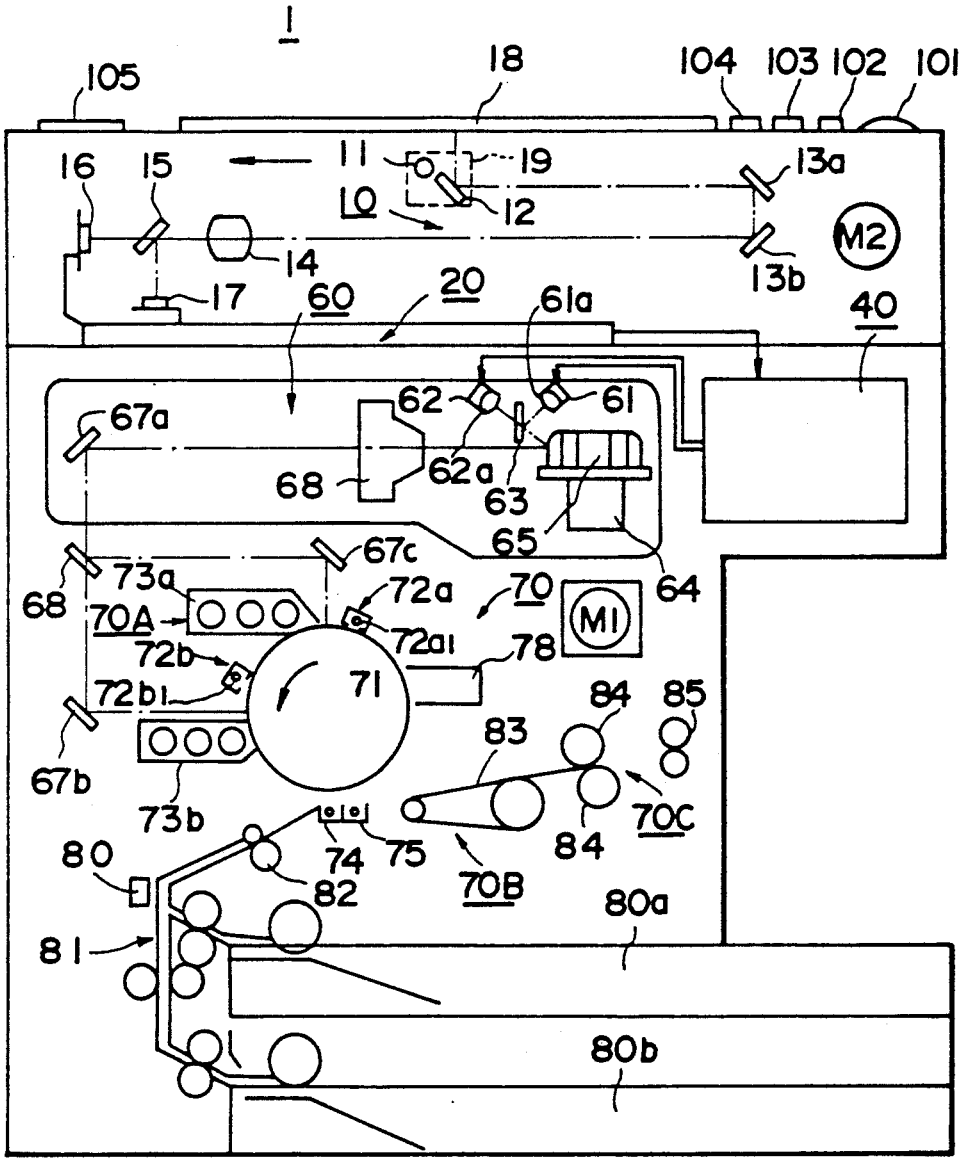
FIG. 1 is a section view briefly showing the construction of a copying apparatus.

FIG. 1 is a section view showing the construction of the copying apparatus 1 capable of two-color copying of the present invention.

The copying apparatus 1 comprises a scanning system 10 which scans documents disposed n the glass document platen 18 and converts electrical signals, image signal processing portion 20 for processing image signals transmitted from said scanning system 10, print processing portion 40 for driving the two semiconductor lasers 61 and 62 in accordance with image data output from the image signal processing portion 20, optical system 60 for guiding the two laser beams emitted by said semiconductor lasers 61 and 62 to mutually dissimilar exposure positions on the surface of the photosensitive drum 71, and an image forming unit 70 for developing the latent image formed by the aforesaid exposure light, transferring said developed image onto a paper sheet and fixing said transferred image thereon.

The scanning system 10 comprises a scanner 19 having a lamp 11 and mirror 12 mounted thereon, stationary mirrors 13*a* and 13*b*, lens 14, half-mirror 15, photoelectric converter elements 16 and 17 using charge-coupled device (CCD) array and the like, and a scan motor M2.

The photoelectric converter elements 16 and 17 respectively convert images of a specific color within an original document such as, for example, red color and the like, and images of a non-specific color, i.e., primarily black, into separate electrical signals.

The image signal processing portion 20 processes the image signals output from the two photoelectric converter elements 16 and 17, discriminates the specific color and non-specific color, and outputs the image data with the added color information to the print processing portion 40.

The print processing portion 40 distributes the respective received image data with added color information to the corresponding of the two semiconductor lasers 61 and 62, and delays the image data fed to the one semiconductor laser 62 in accordance with the difference in the exposure positions of the two respective semiconductor lasers 61 and 62.

The optical system 60 comprises semiconductor lasers 61 and 62, collimator lenses 61*a* and 62*a*, composite mirror 63 comprising a dichroic mirror for combining the two laser beams, polygonal mirror 65, main lens 69, reflecting mirror 67*a*, separation mirror 68 for separating the combined beam into two laser beams, and reflecting mirrors 67*b* and 67*c* and the like.

The image forming unit 70 comprises a developing-transfer system 70A, transport system 70B, and fixing system 70C.

The developing-transfer system 70A is provided with a photosensitive drum 71 that is rotatably driven in the counterclockwise direction in the drawing. Arranged sequentially around the periphery of said drum 71 on the upstream side in the direction of rotation are first charger 72*a*, first developing device 73*a*, second charger 72*b*, second developing device 73*b*, transfer charger 74, separation charger 75, and cleaning portion 76.

The aforesaid chargers 72*a*and 72*b* of chargers of the corona charging type and are provided with grids 72*a*l and 72*b*l, respectively. The developing devices 73*a* and 73*b* respectively include independent vessels, namely a first vessel and a second vessel. The first vessel accommodates a first developing roller and a first developer, whereas the second vessel accommodates a second developing roller and a second developer. The first developer is a two-component developer comprising a red color toner and a carrier, whereas the second developer is a two-component developer comprising a black color toner and a carrier.

The red color toner used in the copying apparatus 1 is a nonmagnetic toner having a mean particle diameter of 11 μm which is triboelectrically charged to have a polarity that is negative relative to the charge of the carrier. Conversely, the black color toner is a magnetic toner having a mean particle diameter of 12 μm which is triboelectrically charged to have a polarity that is negative relative to the charge of the carrier in the same manner as the red color toner. When, however, the electrostatic contrast, which consists of the difference between the developing bias voltage and the surface potential of the photosensitive drum, is not a high value (100 V or higher) compared to the red color toner, the black color toner will not adhere to the surface of the photosensitive drum 71.

The transporting system 70B comprises paper accommodating cassettes 80*a* and 80*b*, paper guide 81, timing roller 82, and transport belt 83. The paper sensor 90 is provided midway on the paper guide 81 to detect the leading edge of the paper fed thereto.

The fixing system 70C comprises heat fixing rollers 84 and a discharge roller 85. A paper sensor is provided in the vicinity of the discharge roller 85 to detect the completed discharge of the paper sheets.

On the other hand, the top of the copying apparatus 1 is provided with operation keys such as print key 101 for starting the printing operation, two-color key 102 for specifying the two-color mode for forming two-color copy images in red and black in a single electrophotographic process, single-color selection key 103 for specifying the single-color mode for forming single-color copy images in either red or black, magnification key 104 for specifying the copy magnification, ten-key pad 105 for specifying the number of copies and the like.

In the copying apparatus 1, the electrostatic contrast is switchable between a value for image formation and a value for toner separation so as to accomplish the toner separation process using the difference in the adhesion charge characteristics of the aforesaid red color toner and the black color toner.

The toner separation process is briefly described hereinafter.

In the two-color mode, the first developing device 73*a* and the second developing device 73*b* are driven simultaneously. Therefore, the red color toner unavoidably contaminates the second developing device 73*b* disposed on the downstream side in the direction of rotation of the photosensitive drum 71.

Accordingly, toner separation is accomplished by adhering only the unnecessary red toner from the second developing device 73*b* to the area (inter-image area) on the surface of the photosensitive drum 71 that does not confront the paper sheet. The unnecessary red toner adhering to the surface of the photosensitive drum 71 is subsequently removed by means of the cleaning portion 76.

In the copying apparatus 1, the toner separation control more specifically is accomplished by switching the grid voltages of the respective chargers 72*a*and 72*b* and the bias voltages of the developing devices 73*a* and 73*b* to predetermined values so as to achieve an electrostatic contrast of about 50 volts at the developing position of the developing device 73*b* with a timing (described later) determined in accordance with the rotational speed of the photosensitive drum 71.

Thus, since the electrostatic contrast must be 100 V or greater for the black toner to adhere to the surface of the photosensitive drum 71, the red toner can thereby be separated from the second developing device 73*b*.

Figure 2:
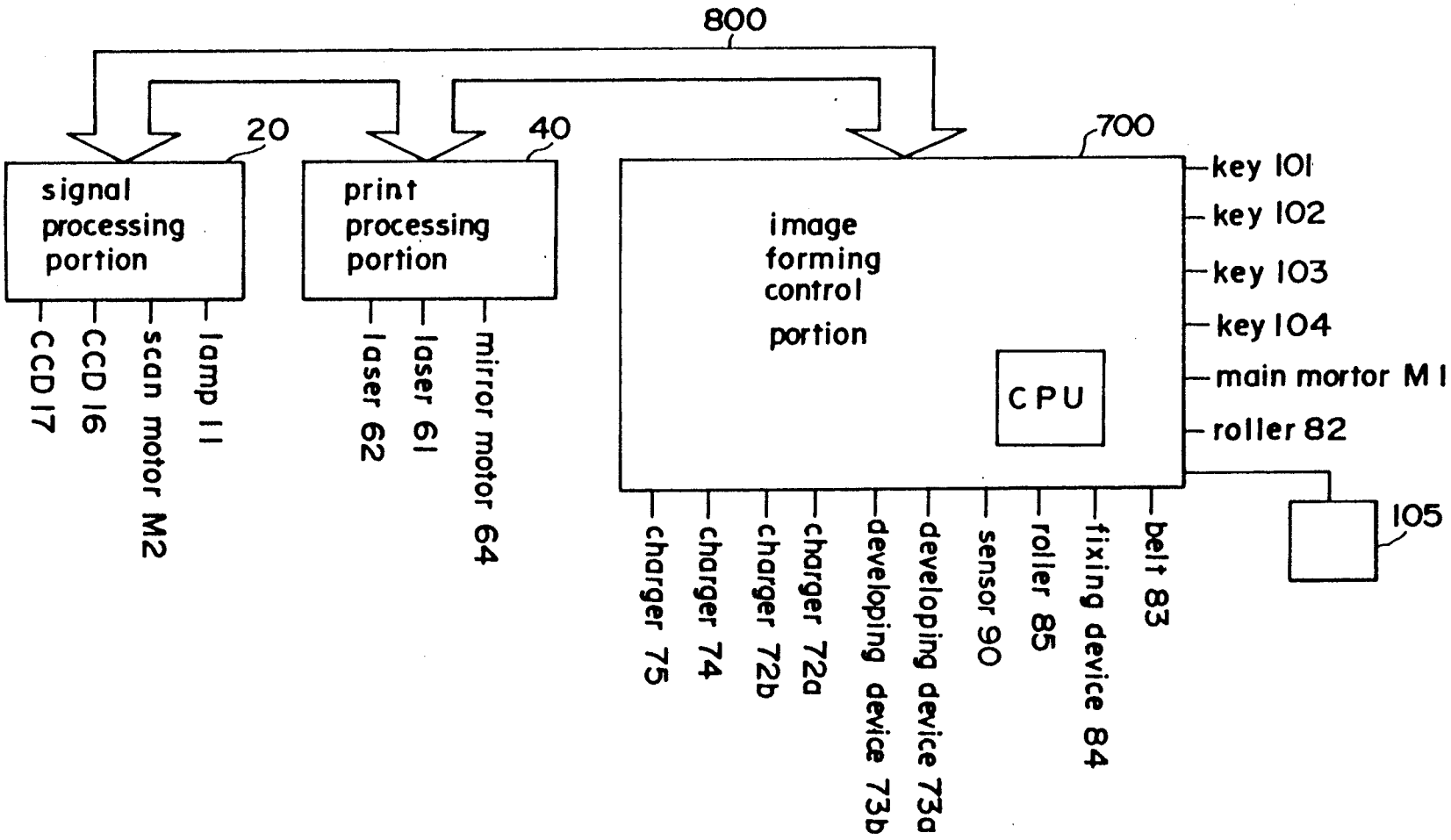
FIG. 2 is a block diagram briefly showing the construction of the control circuit of the copying apparatus.

FIG. 2 shows the construction of the control portions for controlling the copying apparatus 1. The control portions mainly comprise signal processing portion 20, print processing portion 40, and image forming control portion 700, which are mutually connected via the communication line 800.

Figure 3:
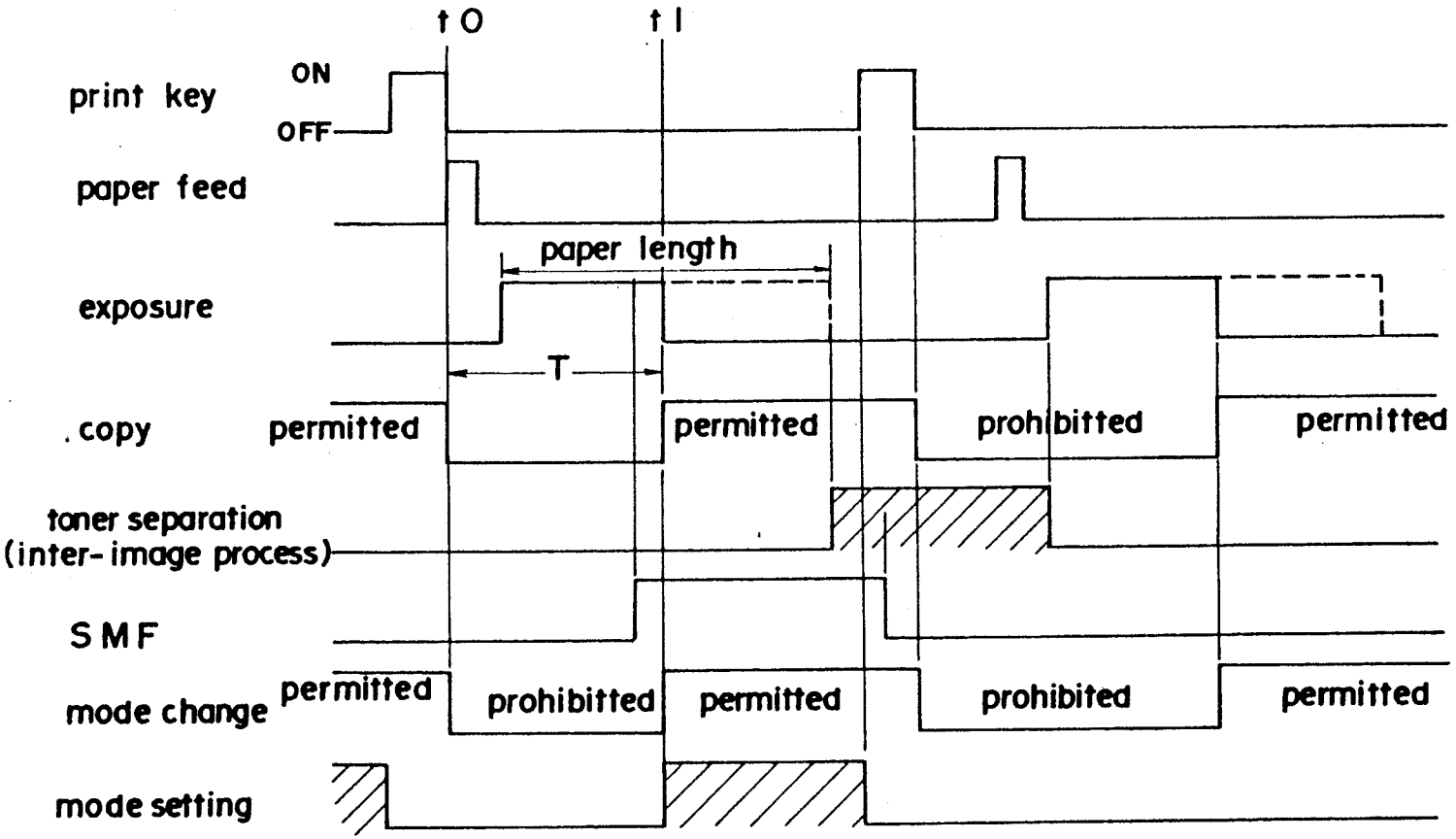
FIG. 3 is a timing chart showing the contents of the control of the copying apparatus.

FIG. 3 is a timing chart showing the control content of the present invention, and further shows a portion of the operation sequence of the copying apparatus 1. The shaded portions in the drawing indicate the processing or operation within a period.

The illustration assumes a single copy in the single-color mode is made after a single copy in the two-color mode. Each single copy is made such that some portions of the latter half of the paper sheet are blank after copying, e.g., a reduction copy made on the same size paper sheet as the original document.

In the standby state wherein copying may start, specifying the various operation modes and changing said specifications are permitted. That is, depressing an operation key is effective.

The operator depresses the aforesaid two-color mode key 102 to specify the two-color mode as the operation mode for image color. Then, the operator depresses the print key 101 to start the copy process.

When the print key 101 is depressed, the CPU that controls the copying apparatus 1 starts the operation of the paper feed for the specified size paper and driving the image forming system 70. At the same time, an operation mode change (hereinafter referred to as "mode change") and a starting a new copy process are prohibited. That is, depressing the two-color selection key 102, single-color selection key 103, and the print key 101 are ineffective at the same time.

Subsequently, the operational stability, particularly of each portion disposed around the periphery of the photosensitive drum 71, is awaited to start the scanning of the original document, whereupon the exposure of the surface of the photosensitive drum 71 (latent image formation) is started in accordance with the image data output from the signal processing portion 20 resulting from the aforesaid scan.

In the two-color mode, parallel exposures are accomplished at a total of two locations respectively corresponding to the colors red and black with a predetermined delay time. At the moment t1 when the exposure ends at the exposure position for the black color on the downstream side, the scan of the original document ends and the switching of the document is allowed such that the next copy is permitted at said moment t1.

In the aforesaid state, the operator can again start the two-color mode copying by depressing the print key 101 after switching the original document or without switching the original document.

In the copying apparatus 1, the contents of the inter-image process is determined in accordance with the operation mode during the time period T lasting from the moment t0 at which the depression of the print key 101 is detected until the moment t1. More specifically, when the two-color mode is selected, the separation mode flag SMF (described later) is set as the inter-image process, whereas when the single-color mode is selected, the separation mode flag SMF is not set.

Thus, at the moment t1 the next copy is permitted and a mode change is permitted without the requirement of maintaining the operation mode throughout the timing for executing the inter-image process.

Accordingly, the operator may change the operation mode from the two-color mode to the single-color mode to start the next copy soon after the moment t1.

When the print key 101 is again depressed after a mode change operation, the single-color mode copy process is started using one of the developing devices 73*a* or 73*b* depending on the selected color. When the second sheet is copied, the sheet feeding is started with a discrete timing so as to provide a predetermined spacing between said second sheet and the first sheet fed for the copy in the two-color mode.

Toner separation (inter-image process) is accomplished with a timing described later in accordance with the previously mentioned separation mode flag during the interval between the exposure of the print exposure of the first sheet and the print exposure of the second sheet.

Figure 4:
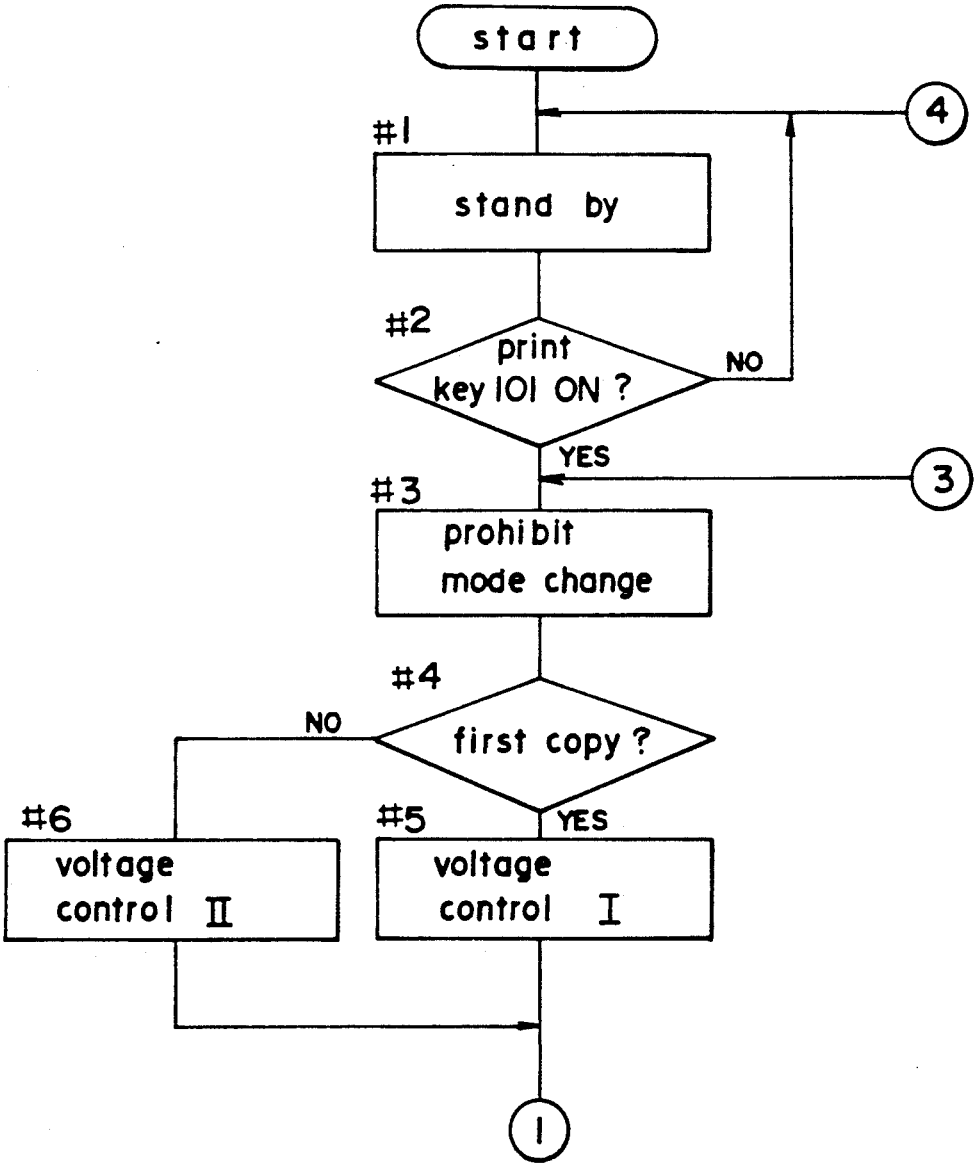
FIG. 4 is a flow chart showing the contents of the control of the copying apparatus.
Figure 5:
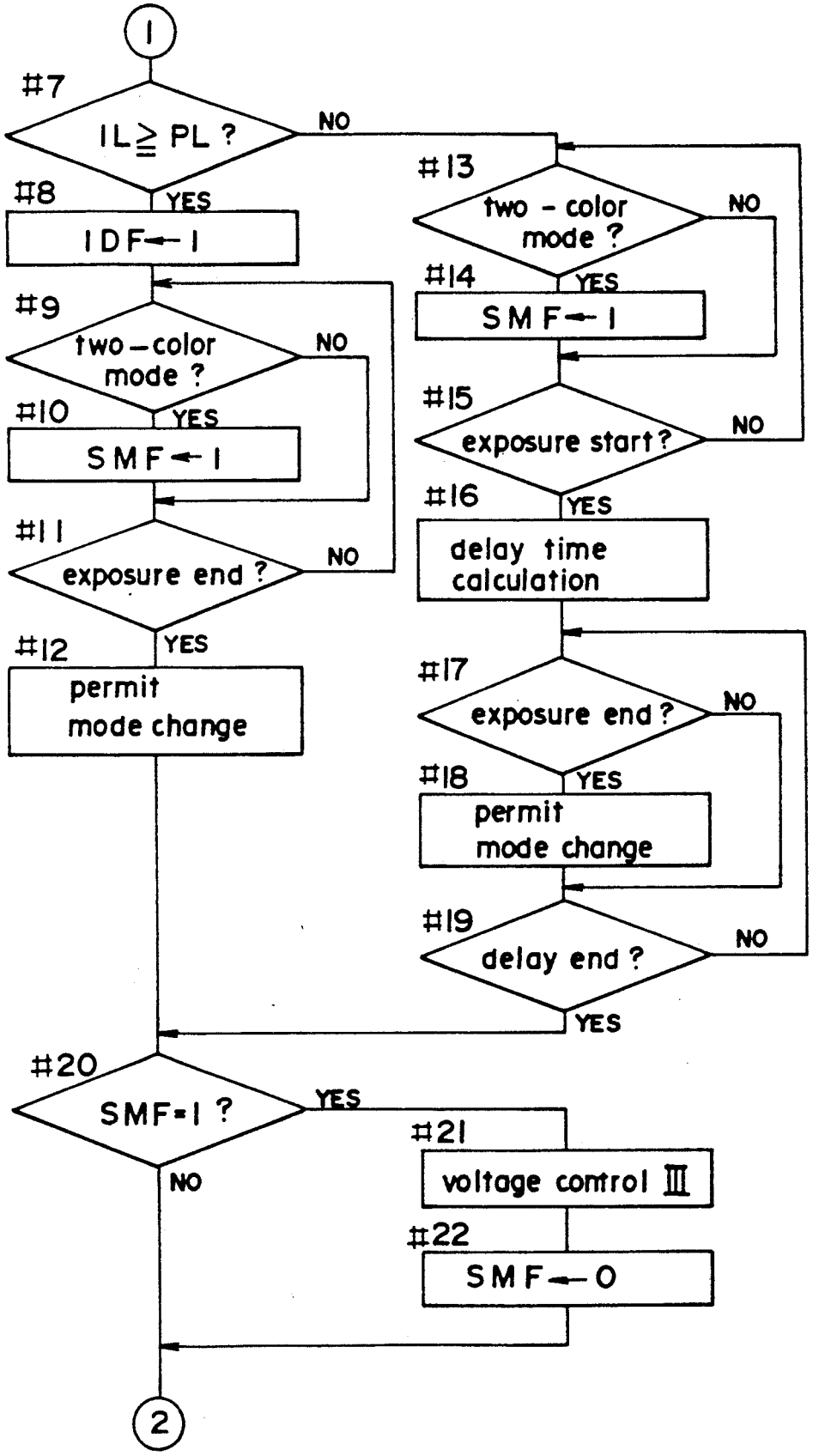
FIG. 5 is a flow chart showing the contents of the control of the copying apparatus.
Figure 6:
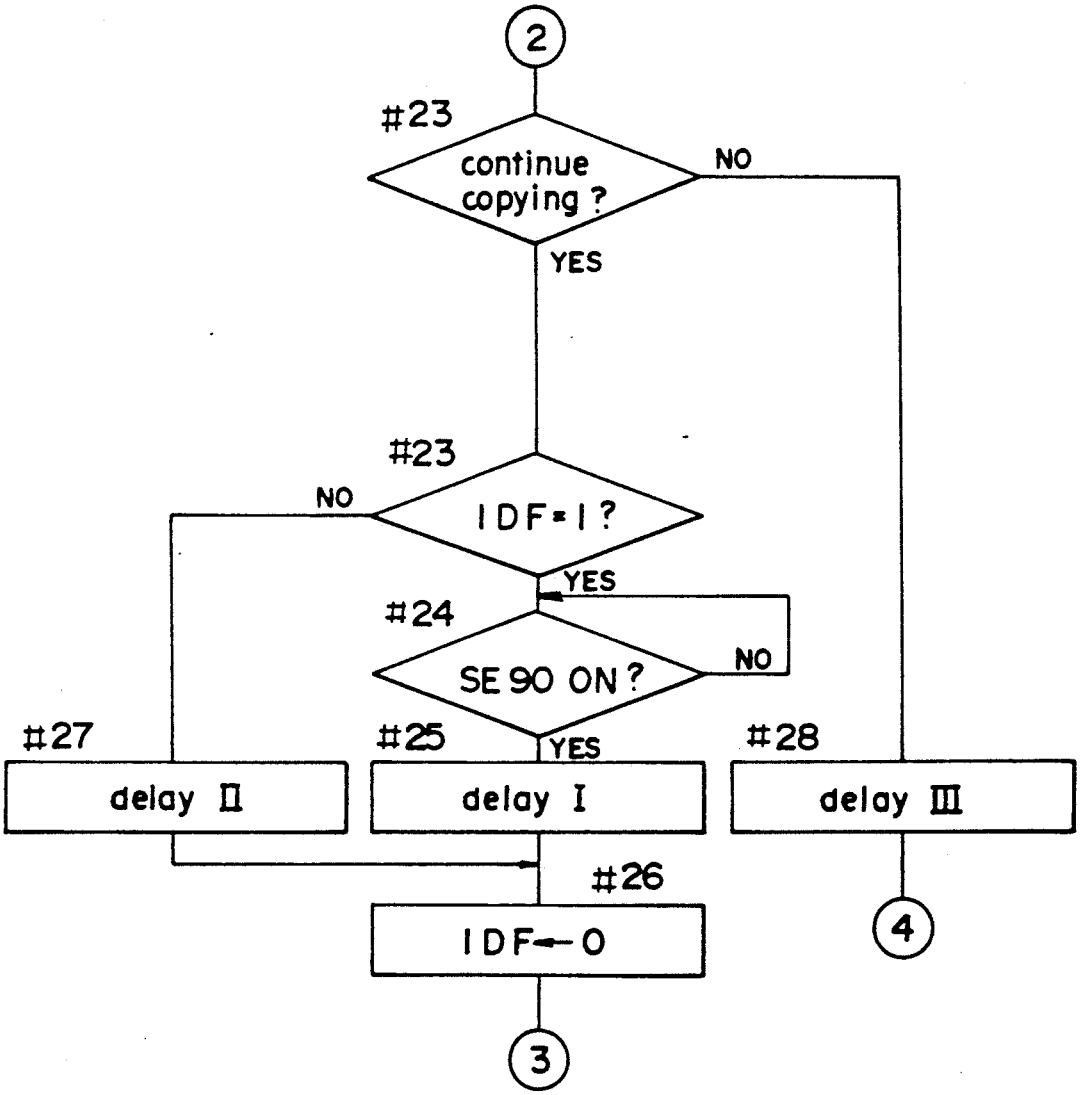
FIG. 6 is a flow chart showing the contents of the control of the copying apparatus.

FIGS. 4 through 6 are flow charts showing the operation of the copying apparatus 1. More specifically, FIGS. 4 through 6 show the elements of control for each portion related to electrostatic contrast.

When the main switch is turned ON, the CPU executes initialization and apparatus enters the standby state wherein input from the print key 101 can be accepted (step #1).

When the print key 101 is turned ON (step #2, YES), mode change is prohibited, and the copy operation is started (step #3). When the copying starts, a check is made to determine whether or not it is the first copy (step #4). At the moment t0 the print key 101 is depressed (refer to FIG. 3), the two-color mode is specified.

If the reply to the query in step #4 is YES, i.e., when the started copy is a single copy or the first sheet of a multiple copy, the voltage control I is executed (step #5).

In the voltage control I, the grid voltage and the developing bias voltage controls are executed to set the electrostatic contrast at a value for image formation in the two-color mode.

That is, in step #5, the voltage of the grid 72*al* is set so as to achieve a charging potential of −550 V on the surface of the photosensitive drum 71 via the charger 72*a*, and the developing bias of the first developing device 73*a* is set at −400 V. Furthermore, the voltage of the grid 72*bl* is set so as to achieve a charging potential of −550 V on the surface of the photosensitive drum 71 via the second charger 72*b*, and the developing bias voltage of the second developing device 73*b* is set at −500 V.

Thus, after the exposed portion (latent image portion) of the surface of the photosensitive drum 71 reaches a charging potential of about −50 V via discharge, the electrostatic contrast at the respective developing positions of the developing devices 73*a* and 73*b* is a value of about 350 V which enables developing via red and black toners.

On the other hand, if the answer to the query in step #4 is NO, i.e., when the started copy is the second or a subsequent sheet of a multiple copy, the voltage control II is executed (step #6). The voltage control II executes a process wherein the electrostatic contrast that has been changed to the value for toner separation at the previous copy is returned to the value for image formation.

That is, in step #6 the voltage of the grid 72*bl*, developing bias voltage of the first developing device 73*a*, voltage of the grid 72*bl*, and the developing bias voltage of the second developing device 73*b* are sequentially set at the same values as in step #5 with predetermined time delays in accordance with the rotational speed of the photosensitive drum 71.

Thereafter, the process of steps #7 through #19 are executed to determine the contents of the inter-image process (i.e., whether or not the toner separation process is necessary) and the execution timing of the inter-image process.

First, in step #7, the image data length IL (corresponding to exposure time) and the paper length PL (corresponding to time defined as the length of the specified paper divided by the circumferential rotational speed of the photosensitive drum 71) are compared. For example, when forming a reduced image of an original document on a paper sheet the same size as the original document, the aforesaid process is executed to prevent the separated red color toner from adhering to some portions of the latter half of the paper sheet which is left blank.

When the image data length is longer than the paper length, the image data flag IDF is set to indicate said condition (step #8), and thereafter a check is made to determine whether or not the two-color mode has been set (step #9). If the two-color mode has been specified at this time, the separation mode flag SMF is set to indicate that toner separation is necessary, and the end of exposure is awaited (steps #10 and #11), whereas if the two-color mode has not been specified, the end of exposure is awaited without setting said separation mode flag SMF.

The aforesaid end of exposure in step #11 means the end of a single exposure in the case of a single copy, and the end of the final exposure in the case of multiple copies.

If the separation mode flag is set, the toner separation process is executed as the inter-image process. If the separation mode flag is not set, however, the toner separation process is not executed.

When the exposure ends at the second exposure position, a mode change is permitted (step #12).

On the other hand, when the image data length IL is shorter than the paper length PL in step #7, a check is immediately made to determine whether or not the two-color mode is selected (step #13), and if said two-color mode has been selected, the separation mode flag SMF is set (step #14). Then, the start of exposure at the second exposure position is awaited (step #15), and when said exposure starts, a predetermined time (paper length/rotational speed of photosensitive drum 71) equivalent to the paper length from said moment is determined, and the clock for said determined period is started (step #16). When the two-color mode has not been selected, the routine advances to step #15 without executing step #14.

When the end of exposure is determined in step #17, a mode change is permitted in step #18. The aforesaid end of exposure in step #17 means the end of a single exposure in the case of a single copy, and the end of the final exposure in the case of multiple copies.

In step #19, a check is made to determine whether or not the time of the clock started in step #16 has ended, and if said time has ended, the routine continues to step #20. Since the image data length IL is less than the paper length PL, the exposure ends before the determination in step #19 is YES.

When the exposure ends or the predetermined time delay ends, the inter-image process execution timing is reached. Whereupon, the next separation mode flag is checked (step #20). when said next separation mode flag has been set, the voltage control III is executed in step #21.

In the voltage control III, the voltage of the grid **72*bl*, developing bias voltage of the first developing device 73*a*. voltage of the grid 72*bl*, and the developing bias voltage of the second developing device 73*b* are sequentially set at the values described below with predetermined time delays in accordance with the rotational speed of the photosensitive drum 71** so as to not affect the image.

First, the voltage of the grid **72*bl* is set so as to achieve a charging potential of −350 V on the surface of the photosensitive drum 71 via the charger 72*a*, then the developing bias voltage of the first developing device 73*a* is set at −200 V. Thus, since exposure does not occur during the inter-image process, the electrostatic contrast at the developing position of the first developing device 73*a* is normally negative and, therefore, the red color toner from said first developing device 73*a* does not adhere to the photosensitive drum 71**.

Next, the voltage of the grid **72*bl* is set so as to achieve a charging potential of 0 V on the surface of the photosensitive drum 71 via the charger 72*b*, then the developing bias voltage of the second developing device 73*b*** is set at −400 V.

Therefore, the electrostatic contrast at the developing position of the second developing device **73*b* is 50 V, and the red toner adheres to the surface of the photosensitive drum 71, whereas the black toner does not. Accordingly, the red toner contaminating in the second developing device 73*b*** is selectively removed therefrom.

After the toner separation is started in step #21 as previously described, the separation mode flag is reset in step #22.

Thereafter, a check is made to determine whether or not continuous copying is executing, i.e., multiple copies are currently executing, or whether or not the print key 101 has been newly depressed (step #23). If the reply to the aforesaid query is NO, a delay process is executed to allow the elapse of a predetermined time as the period of the separation process, after which the chargers **72*a* and 72*b* and the developing biases and the like are turned OFF, and the copying apparatus enters the standby state (steps #24 and #25**).

When the reply to the query in step #18 is YES, i.e., when continuous copies are made, the image data flag is checked in step #23.

When the image data flag has been set and the image data length is longer than the paper length, the arrival of the leading edge of the sheet fed for copying at the position of the paper sensor 90 is awaited (step #24). The delay process I is executed to achieve a delay only for a period equivalent to the difference in the time of travel of the paper from the paper sensor 90 position to arrival at the transfer position and the time of rotation of the photosensitive drum 71 from the first charger **72*a* position to the transfer portion (step #25). Thereafter, the image data flag is reset (step #26) and the routine returns to step #2**.

When the image data flag has not been reset in step #23 and the image data length is shorter than the paper length, the delay process II is executed in step #27 to achieve a delay only for the period wherein the photosensitive drum 71 rotates from the position of the second developing device **73*b* to the position of the first charger 72*a*. Then, step #26 is executed and the routine returns to step #3**.

When the routine returns to step #3, the subsequent inter-image process ends at the moments the steps #5 and #6 are executed.

In the previously described embodiments, mode changes are permitted at the moment the exposure ends in the electrophotographic process. Therefore, when making copies in different modes, the waiting time for

BEST AVAILABLE COPY an operation is reduced compared to the conventional arrangement wherein mode changes are permitted at the moment the electrophotographic process is completed and the paper has been completely discharged. Particularly when reduction copies are made, the exposure is completed at an early stage compared to equal magnification copies for paper of equal size, thereby accelerating access for the next copy.

Although in the previously described embodiments toner separation is accomplished only when copies are made in the two-color mode, it is to be noted that toner separation may also be accomplished in the single-color mode.

Three or more developing devices may also be provided in the above embodiments for forming images with a mixture of three or more colors.

The previously described copying apparatus 1 need not be a stand alone type copying apparatus which uses the scanning system 10 and image signal processing portion 20 to generate image data corresponding to an image of an original document placed on the document platen 18 and form images on paper sheets in accordance with said image data, but may also be used a peripheral device for a computer, word processor and the like.

When the aforesaid copying apparatus 1 is used as a peripheral device (output device) for an external apparatus, the image data are input to the print processing portion 40, not from the scanning system 10, but from the external apparatus through the communication line 800. Furthermore, the mode data for print color and the like are input to the image forming control portion 700 via the communication line 800. Thus, the images are formed on paper sheets in accordance with the image data transmitted from the external apparatus in the specified mode (color) via said external apparatus.

Although the present invention has been described in connection with the preferred embodiments thereof, it is to be noted that various changes and modifications are apparent to those skilled in the art. Such changes and modifications are to be understood as included within the scope of the present invention as defined by the appended claims, unless they depart therefrom.

What is claimed is:

1. An image forming apparatus operable in one of a plurality of operation modes, comprising:

photosensitive member;

charging means for charging the surface of said photosensitive member;

exposing means for exposing the surface of said photosensitive member charged to an image light in order to form an electrostatic latent image;

developing means for developing said electrostatic image with a first developer and a second developer, said developing means including a first vessel containing said first developer and a second vessel containing said second developer;

mode selecting means for selecting one of the operation modes;

start command input means for inputting a start command;

image process control means, responsive to start command, for executing an image forming process in a selected operation mode in which said charging means, said exposing means and said developing means are operated in a predetermined timed sequence in order to form a visual image on the photosensitive member;

inter-image process control means for executing an inter-image process in which said charging means and said developing means are operated in another predetermined timed sequence in order to remove said first developer mixed into said second developer therefrom, said inter-image process control means starting said inter-image process after completion of said image forming process; and mode selecting control means for inhibiting mode selection by said mode selection means during the exposing operation and for removing the inhibition after the exposing operation, whereby the operation mode is changeable during the interimage process.

2. The image forming apparatus as claimed in claim 1, wherein said exposing means includes a laser beam device which emits a laser beam onto the surface of said photosensitive member.

3. The image forming apparatus as claimed in claim 1, wherein said operation modes include a single color mode in which the electrostatic latent image is developed with one of said first developer and said second developer and a two-color mode in which the electrostatic latent image is developed with both said first developer and said second developer.

4. The image forming apparatus as claimed in claim 3, wherein said inter-image process is executed after completion of said image forming process in the two-color mode.

5. An image forming apparatus operable in one of a plurality of operation mode, comprising:

photosensitive member;

image forming means for forming an electrostatic latent image on the surface of the photosensitive member;

developing means for developing said electrostatic image with a plurality of kinds of developers into a visual image on said photosensitive member;

mode selecting means for selecting one of the operation modes;

start command input means for inputting a start command;

process control means, responsive to said start command, for executing an image forming process in a selected operation mode with the operation of said image forming means and said developing means in a predetermined timed sequence, said image forming process including an actual process in which said electrostatic image is formed by said image forming means and developed by said developing means so as to form a visual image on the photosensitive member and an inter-image process in which a condition of said developing means is arranged for the next image forming operation; and mode selecting control means for inhibiting the mode selection by said mode selection means during the actual process and for removing the inhibition during the inter-image process, whereby the operation mode is changeable during the interimage process.

6. An image forming apparatus as claimed in claim 5, wherein said process control means operates both said image forming means and developing means during said actual process and operates said developing means without operating said image forming means during said inter-image process.

7. An image forming apparatus as claimed in claim 5, wherein said developing means includes a plurality of discrete vessels corresponding to said plurality of kinds of developers, each of said discrete vessels containing a predetermined kind of developer corresponding to the vessel: and said inter-image process removes the undesired kind of developer mixed into another kind of developer therefrom.

8. An image forming apparatus as claimed in claim 5, wherein said process control means completes the image forming process corresponding to a selected operation mode that has been selected before the start of the image forming process irrespective of a mode change during the image forming process.

* * * * *